US006955107B2

(12) United States Patent
Alitalo et al.

(10) Patent No.: US 6,955,107 B2
(45) Date of Patent: Oct. 18, 2005

(54) EQUIPMENT FOR CUTTING PARTICULARLY A PAPER WEB WITH A WATER JET

(75) Inventors: Markus Alitalo, Oulu (FI); Petri Enwald, Tuusula (FI); Mikko Hakuli, Jyväskylä (FI); Markku Lyytinen, Jyväskylä (FI); Samppa J. Salminen, Jyväskylä (FI); Anssi Toivanen, Jyväskylä (FI); Mika Viljanmaa, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/398,010

(22) PCT Filed: Oct. 1, 2001

(86) PCT No.: PCT/FI01/00852

§ 371 (c)(1),
(2), (4) Date: Jul. 28, 2003

(87) PCT Pub. No.: WO02/28605

PCT Pub. Date: Apr. 11, 2002

(65) Prior Publication Data

US 2004/0011175 A1 Jan. 22, 2004

(30) Foreign Application Priority Data

Oct. 2, 2000 (FI) ..... 20002166

(51) Int. Cl.[7] ..... B26D 7/18

(52) U.S. Cl. ..... 83/112; 83/168; 83/177

(58) Field of Search ..... 83/24, 27, 53, 83/98, 99, 100, 109, 112, 162, 168, 169, 177, 23, 102, 102.1, 104; 451/87–88; 162/286, 278, 279

(56) References Cited

U.S. PATENT DOCUMENTS

| | | | | | |
|---|---|---|---|---|---|
| 3,405,031 | A | * | 10/1968 | Sisson | 162/310 |
| 3,556,936 | A | | 1/1971 | Miyamoto | |
| 4,006,656 | A | * | 2/1977 | Shinomiya | 83/864 |
| 5,062,334 | A | | 11/1991 | Killilea et al. | |
| 5,571,381 | A | * | 11/1996 | Vessari et al. | 83/177 |
| 5,644,962 | A | | 7/1997 | Koponen et al. | |
| 5,852,963 | A | * | 12/1998 | Koponen et al. | 83/53 |
| 6,001,219 | A | | 12/1999 | Caspar | |
| 6,021,699 | A | * | 2/2000 | Caspar | 83/177 |
| 6,022,452 | A | | 2/2000 | Caspar | |
| 6,327,948 | B1 | * | 12/2001 | Tuori | 83/53 |

FOREIGN PATENT DOCUMENTS

| | | | |
|---|---|---|---|
| EP | 0 886 055 A2 | | 12/1998 |
| EP | 0 897 889 A1 | | 2/1999 |
| WO | WO-9515837 | * | 6/1995 |
| WO | WO 97/11814 A1 | | 4/1997 |
| WO | WO 02/28605 A1 | | 4/2002 |

OTHER PUBLICATIONS

International Preliminary Examination Report issued in International Patent Application No. PCT/FI01/00852.

* cited by examiner

*Primary Examiner*—Stephen Choi
(74) *Attorney, Agent, or Firm*—Stiennon & Stiennon

(57) ABSTRACT

Support and positioning means (10) and a cutting head (13) supported on them extend in the operating position of the area of the edge part (14') of a paper web (14). In the cutting head (13), there is a support surface (16) and at least one nozzle (17), which is set in such a way that the edge part (14') travels between the support surface (16) and the nozzle (15). The equipment includes mechanical cleaning means (20) and/or a cleaning construction (21) for keeping the support surfaces (16) clean. The cleaning means (20) and/or cleaning construction (21) are arranged on the opposite side of the paper web (14) to the nozzle (17).

4 Claims, 9 Drawing Sheets

EQUIPMENT FOR CUTTING PARTICULARLY A PAPER WEB WITH A WATER JET

CROSS REFERENCES TO RELATED APPLICATION

This application is a U.S. national stage application of Internatinal Application No. PCT/FI01/00852, field Oct. 1, 2001, and claims priority on Finnish Application No. 20002166 filed Oct. 2, 2000, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to equipment for cutting particularly a paper web with a water jet, which equipment includes support and positioning means and a cutting head supported on them extending in the operating position to the edge part of the paper web, in which there is a support surface arranged at least beneath the edge part and, above it, at least one nozzle for forming a cutting jet with the aid of high-pressure water, which nozzle is set in such a way that the edge part travels between the support surface and the nozzle, in order to cut an edge strip from the paper web.

Finnish publication print number 98346 discloses equipment for cutting the edge of a paper web. In this case, for the actual cutting, the equipment includes a nozzle for forming a cutting jet with the aid of high-pressure water, and a surface arranged beneath the nozzle. In the cutting situation, the paper web travels between the nozzle and the surface, so that the water jet cuts the paper web. There is a hole in the surface for the cutting jet and, at this point beneath the surface, there are outlet connections for removing the cutting water from the equipment. The surface is also termed a table, the location of which together with the nozzle can be adjusted in the cross direction of the paper web.

Despite the hole in the surface and blasts of air direction towards the cutting point and the outlet connections, a lump of paper fibers and fillers accumulates very quickly on the surface after the cutting point. The problem appears particularly when cutting paper grades with a high filler content. The problem is the same, both in the above and in other known equipment. In principle, the equipment is designed in such a way that the paper web is only just separated from the surface by an air cushion. In practice, either the edge strip that has just been cut, or even the entire paper web can touch or catch on the lump, which usually results in a web break. The lump also interferes with the creation of the air cushion. The surface can be manually cleaned during a maintenance shutdown, but when the equipment is operating, the surface cannot be kept clean by means of the known art, despite the air blasts. Reliably operating cutting would, however, be a precondition for successful continuous paper production.

SUMMARY OF THE INVENTION

The invention is intended to create an entirely new type of equipment for cutting particularly a paper web with a water jet, which equipment can be easily kept clean, and on which detrimental lumps do not form. The equipment according to the invention includes many different alternatives for keeping the equipment clean and thus for preventing the formation of a lump. Different constructions can be selected for specific cases and it is also easy to combine the constructions. In this way, troublefree cutting is ensured, thus improving the efficiency of the entire paper production.

BRIEF DESCRIPTION OF THE DRAWINGS

In the following, the invention is examined in detail with reference to the accompanying drawings showing certain embodiments of the invention.

DESCRIPTION OF THE PREFERRED EMBODIMENTS

Figure 1B:
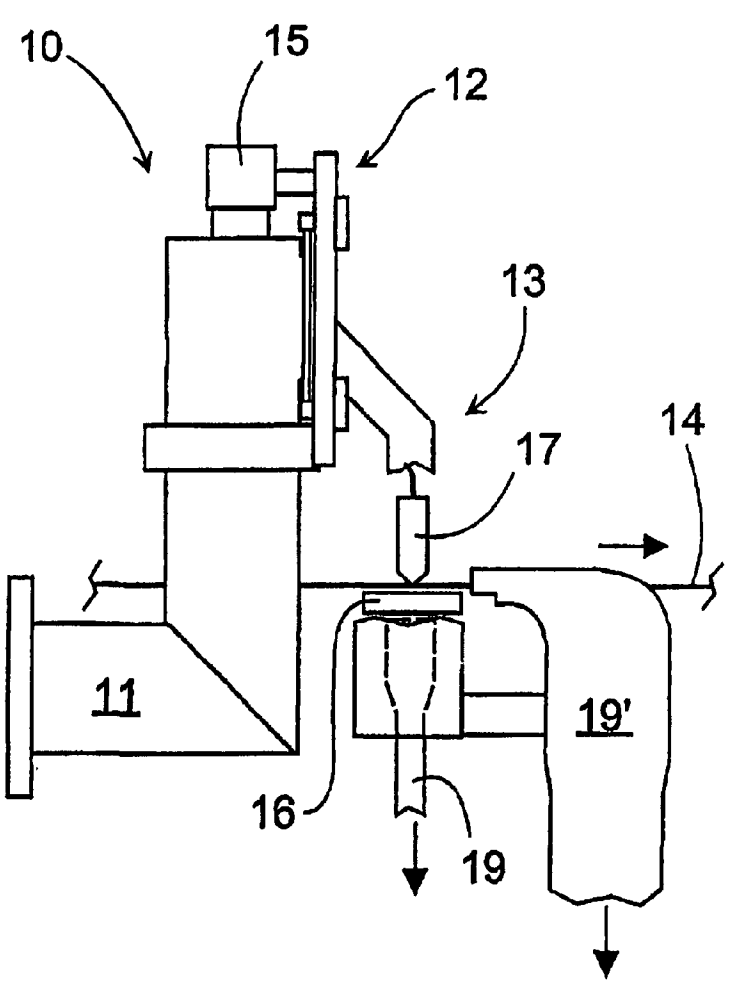
FIG. 1*b* shows a side view of the equipment of FIG. 1*a*.
Figure 1A:
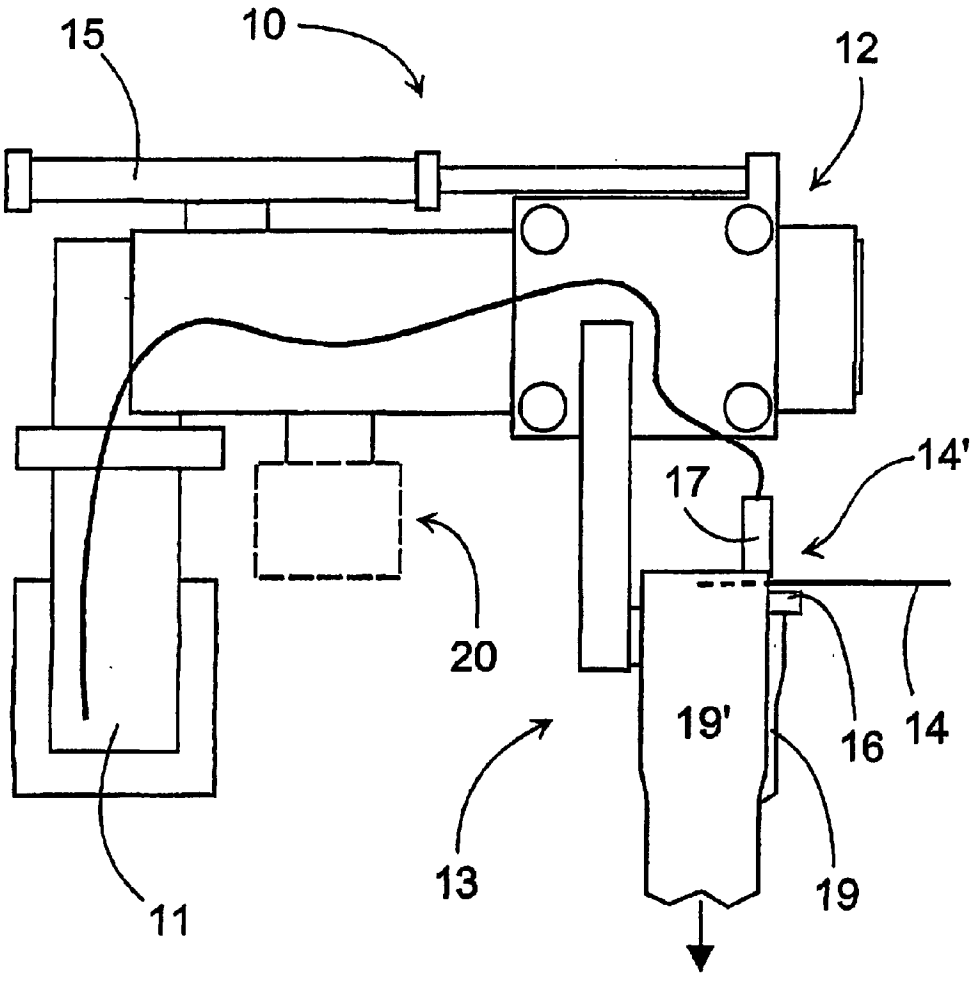
FIG. 1*a* shows a front view of the equipment according to the invention.

FIGS. 1*a* and 1*b* show a front and side view of the equipment according to the invention. In this case, the equipment includes support and positioning means 10, which comprise a support arm 11 and a guide construction 12 adapted to it. The support arm 11 is attached to a suitable point in the paper machine, usually to both sides of the paper web. The equipment is usually located at the end of the paper machine, near the reeler. In addition to a paper machine, the equipment can also be used in conjunction with board machines and similar, for cutting even a thick web. In FIGS. 1*a* and 1*b*, the equipment is shown in the operating position, when the cutting head 13 attached to the guide construction 12 extends to the area of the edge part 14' of the paper web 14. With the aid of the guide construction 12 and the operating device 15 connected to it, the cutting head 13 is positioned at the desired point and correspondingly the cutting head can be moved from the operating position to the maintenance position (not shown).

In the cutting head 13, there is a support surface 16 arranged at least beneath the edge part 14' and above it at least one nozzle 17 for forming a cutting jet with the aid of high-pressure water. The cutting head 13 is arranged in such a way that the edge part 14' travels between the support surface 16 and the nozzle 17, so that an edge strip 18 is cut from the paper web 14. In addition, in the cutting head 13 there are connections 19 and 19' for removing the cutting water and the edge strip 18 from the equipment. Part of the cutting waste is also removed along with the cutting water.

The invention relates to the cutting head 13 of the equipment and particularly to keeping the support surface 16 clean, so that disturbances caused by cutting are avoided. According to the invention, there are two main ways of keeping the support surface clean. The first is the active cleaning of the support surface and the second is the passive prevention of the dirtying of the support surface. For this purpose, the equipment includes mechanical cleaning means 20 and/or a cleaning construction 21 for keeping the support surface 16 clean. In the following, various alternative applications are presented, which realize at least one of the invention's objectives.

In order to implement the first objective, mechanical cleaning means 20 are arranged in connection with the equipment and/or the support surface 16, to clean the support surface. In addition, the cleaning means are arranged to operate continuously or at intervals. The construction of the support surface greatly affects the choice of the manner of operation of the cleaning means.

It is possible to manufacture a general model of the cleaning means, which is suitable for all support surfaces. Such cleaning means 20 are arranged in the equipment, outside the edge part 14' of the paper web 14, in which case the support surface 16 is arranged to be cleaned by moving the cutting head 13 with the aid of the support and positioning means 10 to the location of the cleaning means 20. The cleaning means 20 located outside the edge part 14' are shown in FIG. 1*a* schematically with a broken line. It is preferable to use a high-pressure water jet and, if necessary, a brush device as the cleaning means. Due to the construction in question, the support surface must be moved from the cutting position to the cleaning position, so that cutting cannot be carried out during cleaning.

Figure 2A:
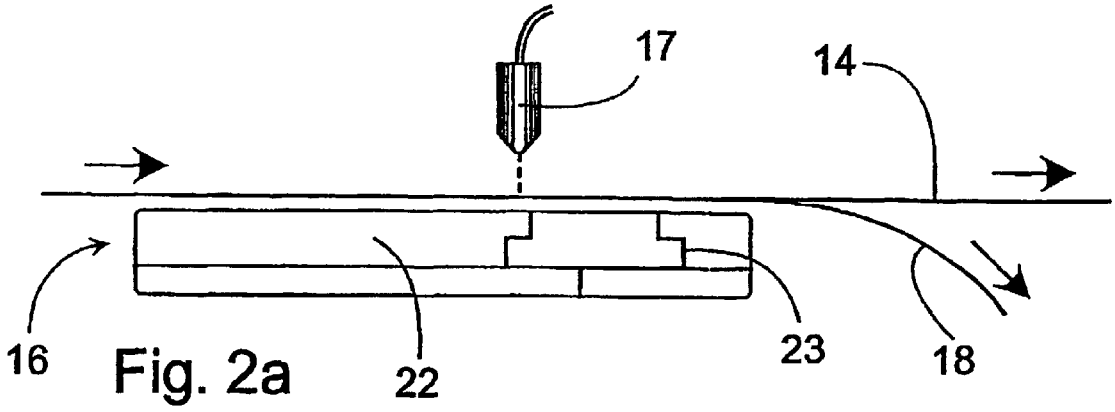
FIGS. 2*a* and 2*b* show a side and top view of a first embodiment of the cutting head of the equipment according to the invention.
Figure 2B:
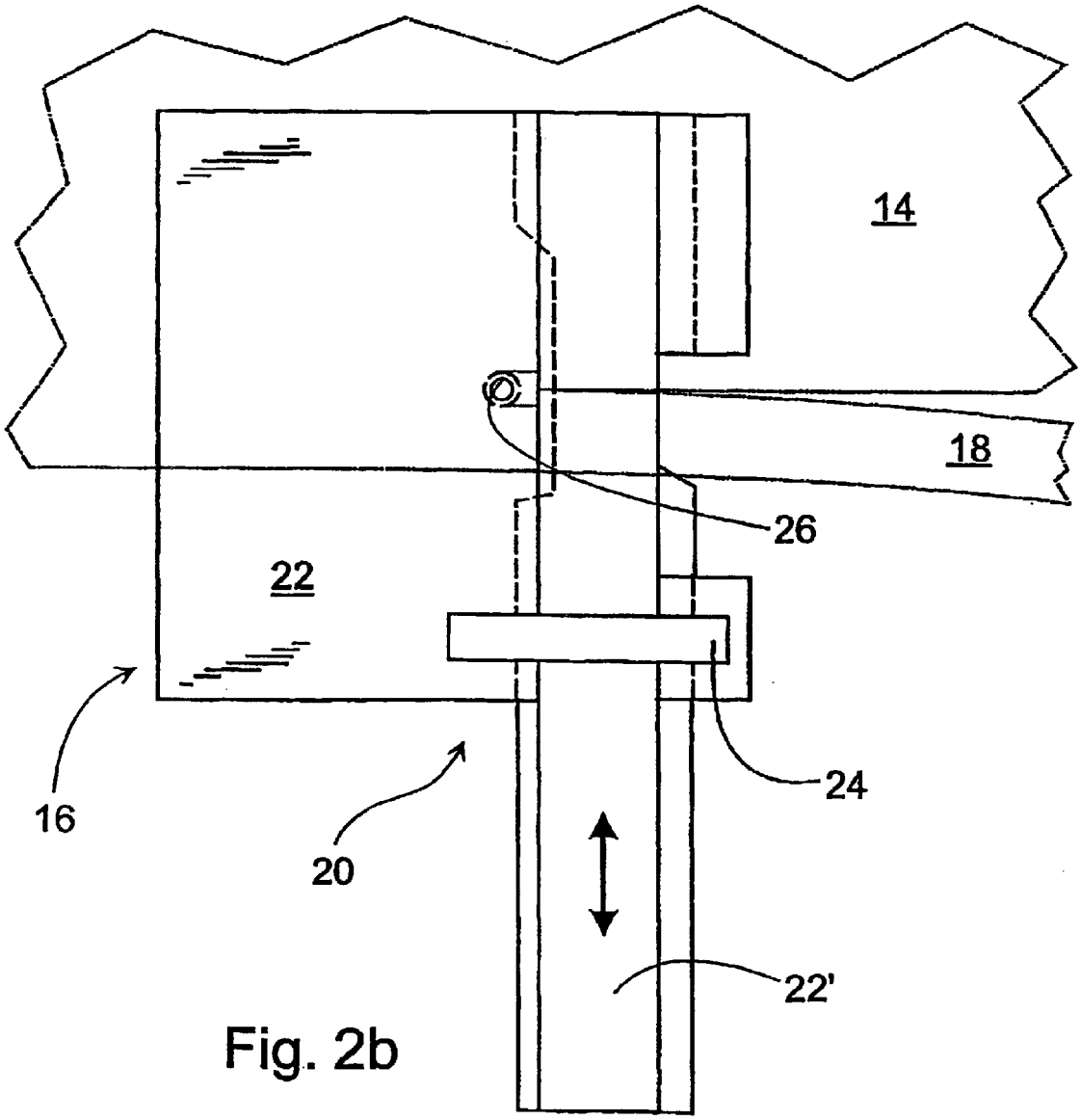

FIGS. 2*a* and 2*b* show a support surface 16, which is formed of a nearly conventional level table 22. However, precisely the part 22' of the support surface 16 after the cutting point is arranged to be able to be moved laterally in the working position of the cutting head. The relevant part 22' forms a slide, which moves in a guide groove 23 machined in the support surface 16. By moving the slide laterally, the dirt collects over a larger area, so that a detrimental lump is not able to form. In addition, cleaning means 20 are arranged in connection with the support surface 16. Thus, the surface of the slide can also be cleaned outside the edge area, for example, by means of a mechanical scraper 24 (FIG. 2*b*). The slide can be moved without disturbing the cutting or the movement of the paper web. In that case, the support surface with the cleaning means is well suited to continuous operation. The same reference numbers are usually for functionally similar components.

Figure 3A:
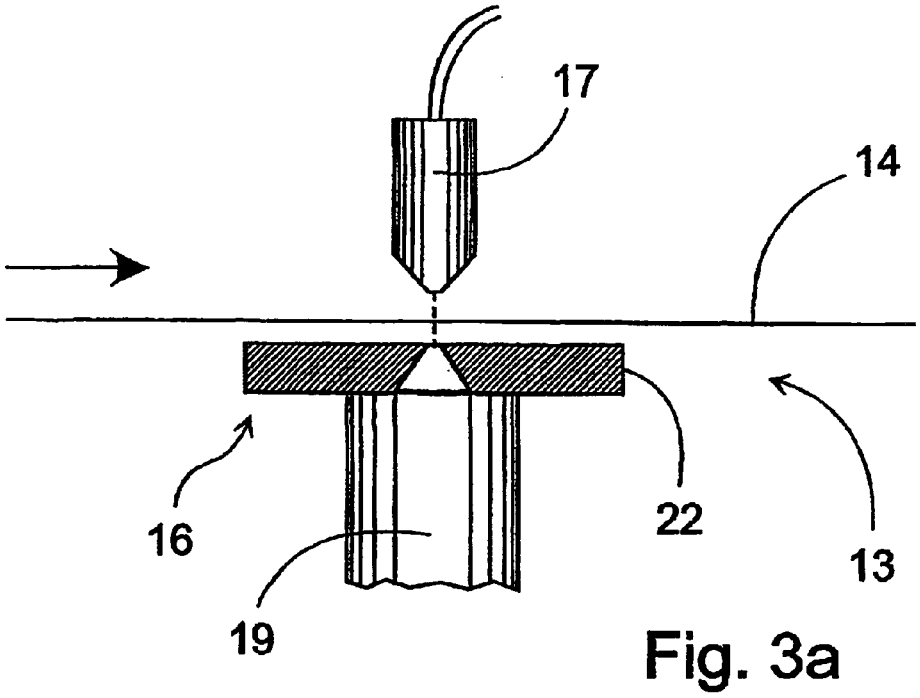
FIGS. 3*a* and 3*b* show a side and top view in partial cross-section of a second embodiment of the cutting head of the equipment according to the invention.
Figure 3B:
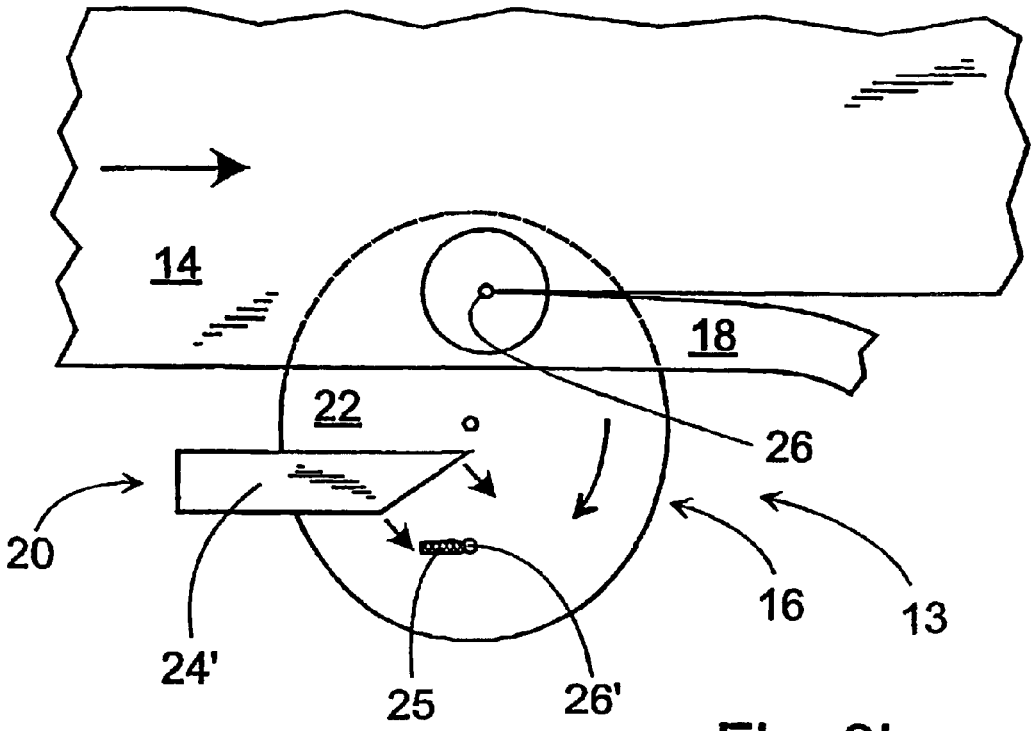

Besides the linear movability described above, the entire support surface or part of it is arranged to rotate around its vertical axis. Correspondingly, the cleaning means 20 are outside the edge part of the paper web. FIGS. 3*a* and 3*b* show side and top views of the cutting head 13 according to the invention. In this case, the support surface 16 forms a table 22 arranged to rotate. FIG. 3*b* also shows a lump 25 that has accumulated on the surface of the table 22. In table 22, there is a hole 26 at the location of the nozzle 17 and beneath it there are connections 19 for removing water from the equipment. In table 22, there is also a second hole 26' correspondingly positioned. Between cutting, the table 22 is rotated through 180°, so that the dirtied part of the table comes outside the paper web 14, where it can be easily cleaned, for example, with a water jet or a mechanical detent 24'. During the rotation, cutting is, in principle, possible, but it is recommended to turn the table 22 between cutting sessions, for example, during roll changes at the reeler. In place of two holes, it is also possible to use several holes.

Figure 4A:
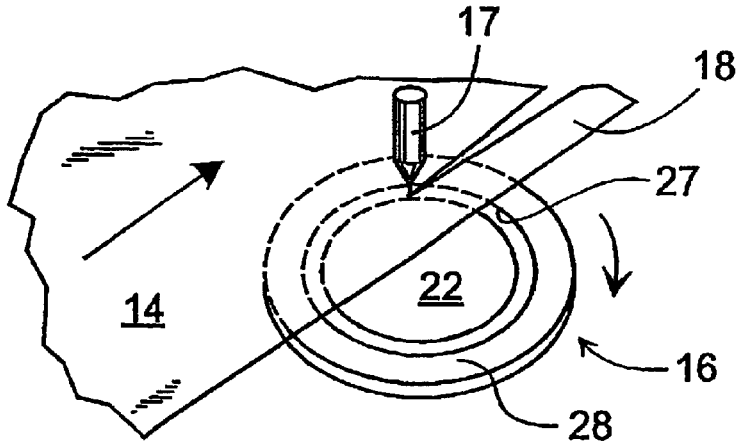
FIGS. 4*a*, 4*b*, and 4*c* show top views of a third, fourth, and fifth embodiments of the cutting head of the equipment according to the invention
Figure 4B:
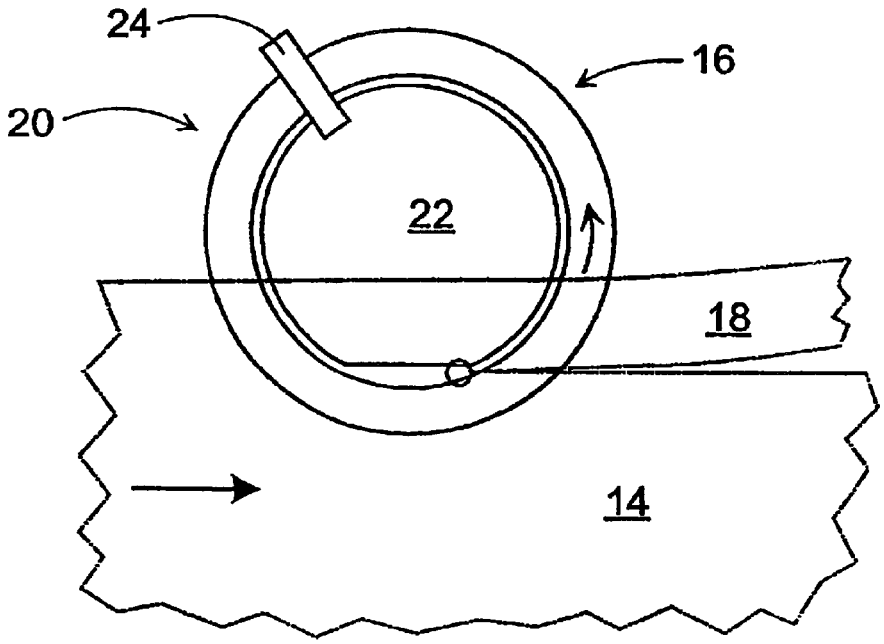

Continuous cutting can be implemented by means of a variation of the embodiment described above, which is shown in FIGS. 4*a* and 4*b*. In the table 22 of FIG. 4*b*, there is not only two holes, but a unified gap 27. The paper web 14 is cut at precisely the location of the gap 27, so that the table 22 can be rotated the whole time. In the table 22 shown in FIG. 22, only the outer ring 28, which covers the area that dirties most, rotates. The outer ring 28 can be easily cleaned by means of a mechanical scraper 24 outside the edge part 14'. Corresponding cleaning can also be used in connection with the table of FIG. 4*a*.

Figure 4C:
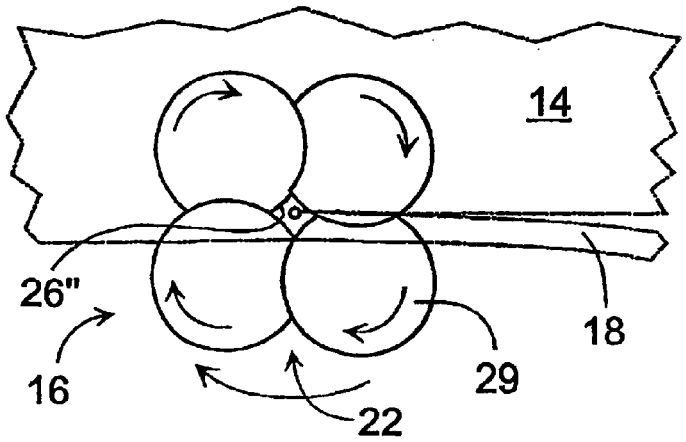

FIG. 4*c* also shows a solution based on rotation. In this case, the table 22 comprises four round components 29, which are rotated together or separately. Thus, the dirt collects evenly on the surface of the components 29. By rotating the entire table 22, the parts beneath the paper web 14 can be moved outside it, so that it is also possible to clean them. In addition, the rotational movement of each component can also be exploited in cleaning. The rotation or cleaning of the components does not affect the cutting itself, which takes place at the point of the opening 26" delimited by the components 29.

In addition to a flat surface, a curved surface can also be used as the support surface according to the invention. In that case, the support surface is arranged to be rotatable around its horizontal axis. In the following, three such embodiments are examined.

Figure 5A:
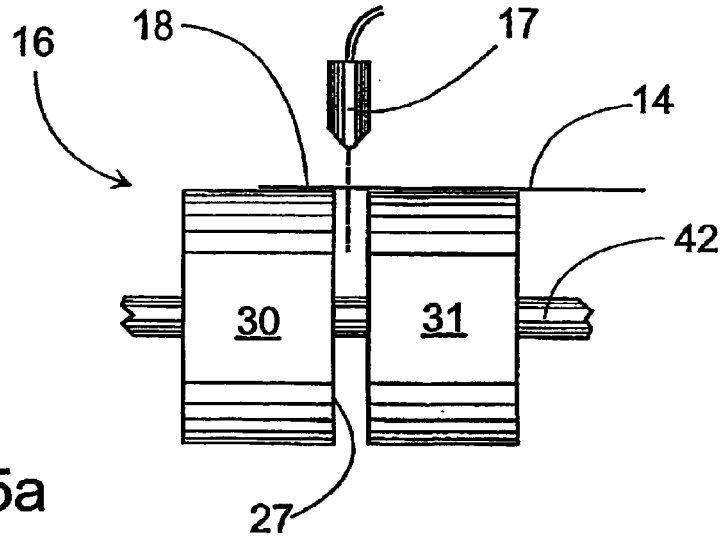
FIGS. 5*a*, 5*b*, and 5*c* show a front and side view in partial cross-section of a sixth and seventh embodiment of the cutting head of the equipment according to the invention.
Figure 5B:
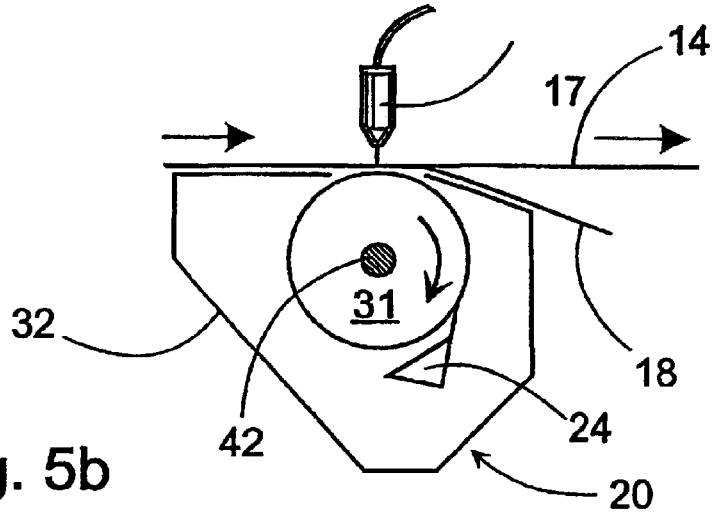

FIGS. 5*a* and 5*b* show front and sides view of the embodiment. In this case, the support surface 16 is formed by two rollers 30 and 31, which are supported rotatably on the same axle 42. Between the rollers 30 and 31, there is a suitable gap 27, in which the cutting can be carried out. Beneath the rollers 30 and 31, there is also a trough 32, in which the cutting water is collected. The surface of the rollers 30 and 31 can also be easily cleaned, for example, with a mechanical scraper 24.

Figure 5C:
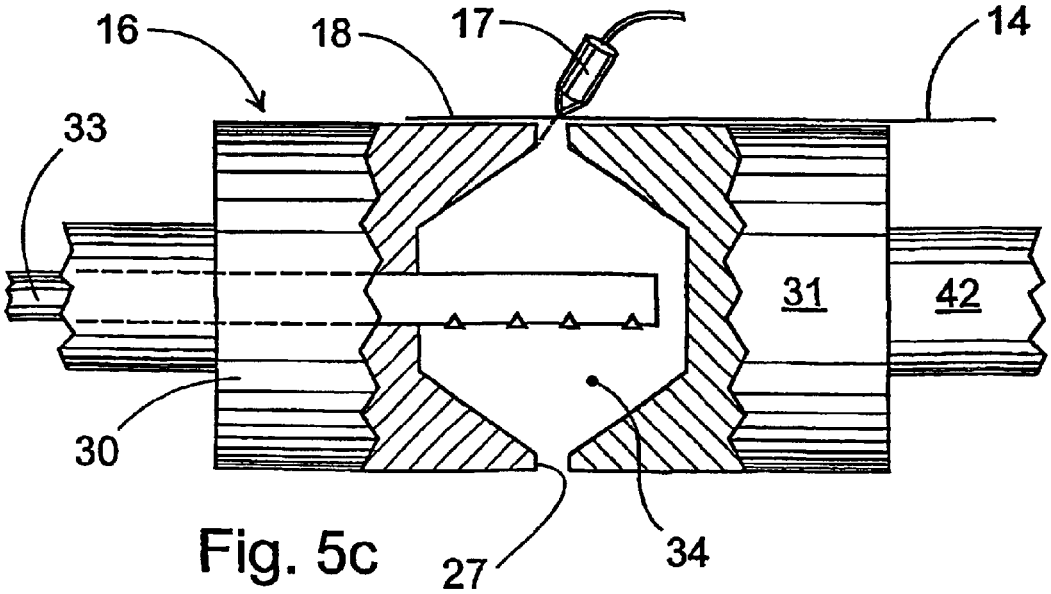

FIG. 5*c* shows a variation of the above embodiment. In it, the rollers 30 and 31 are specially shaped at their opposite ends. Thus, they can be placed as close as possible to each other, when it is possible to use a small gap 27. In addition, by leading a water pipe 33 inside the chamber 34 thus formed, the chamber 34 can also be kept clean.

Figure 6A:
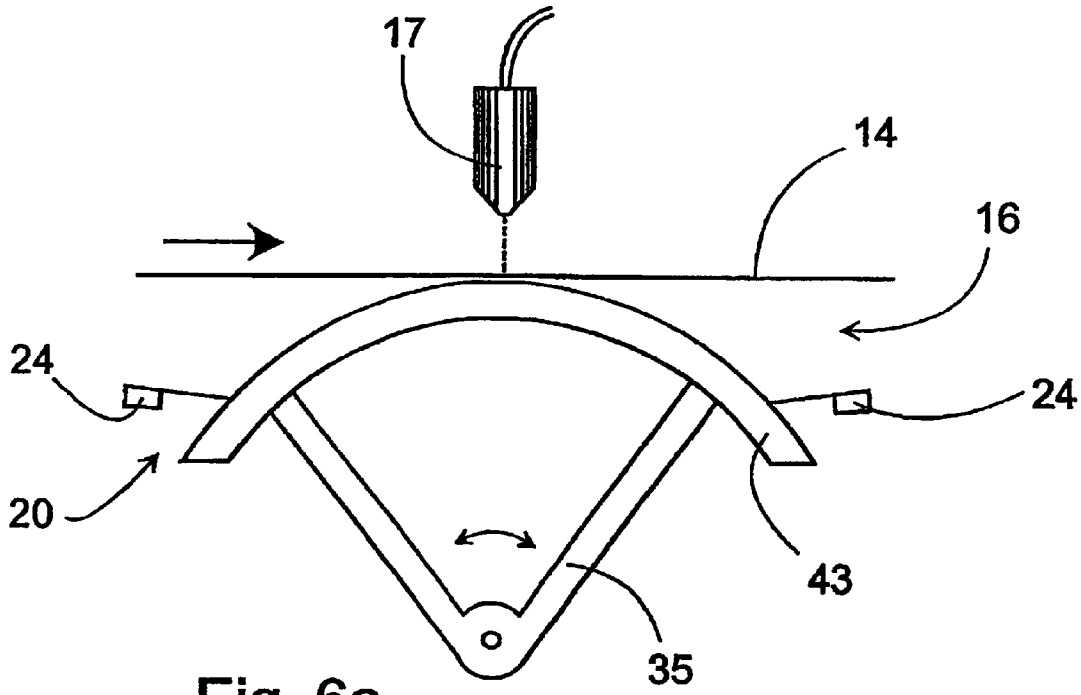
FIGS. 6*a* and 6*b* show a side and top view of an eighth embodiment of the cutting head of the equipment according to the invention.
Figure 6B:
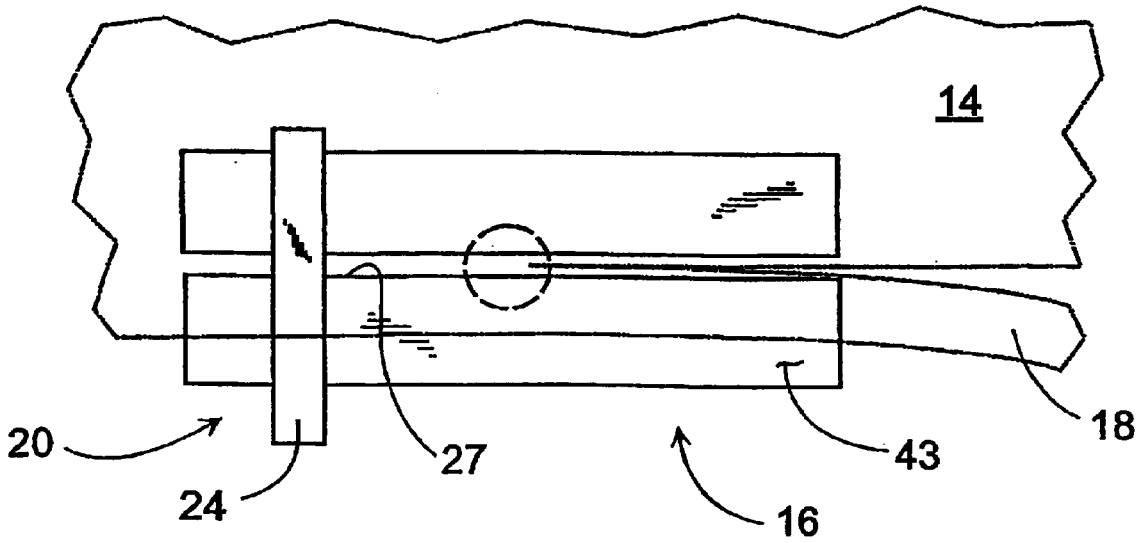

FIGS. 6*a* and 6*b* also show a curved support surface 16, however, this is not rotated, but moved backwards and forwards. For this purpose, the support surface 16 is supported on suitable support arms 35. The operating device is not shown. The support surface 16 is formed of two components 43, between which a suitable gap 27 is left. During cutting, fibers and filler can also adhere to the components 43, so it is preferable to clean the components 43 by means of a mechanical scraper 24 beneath the paper web 14. A suitable trough (not shown) is also used beneath the support surface 16 described above.

Figure 7A:
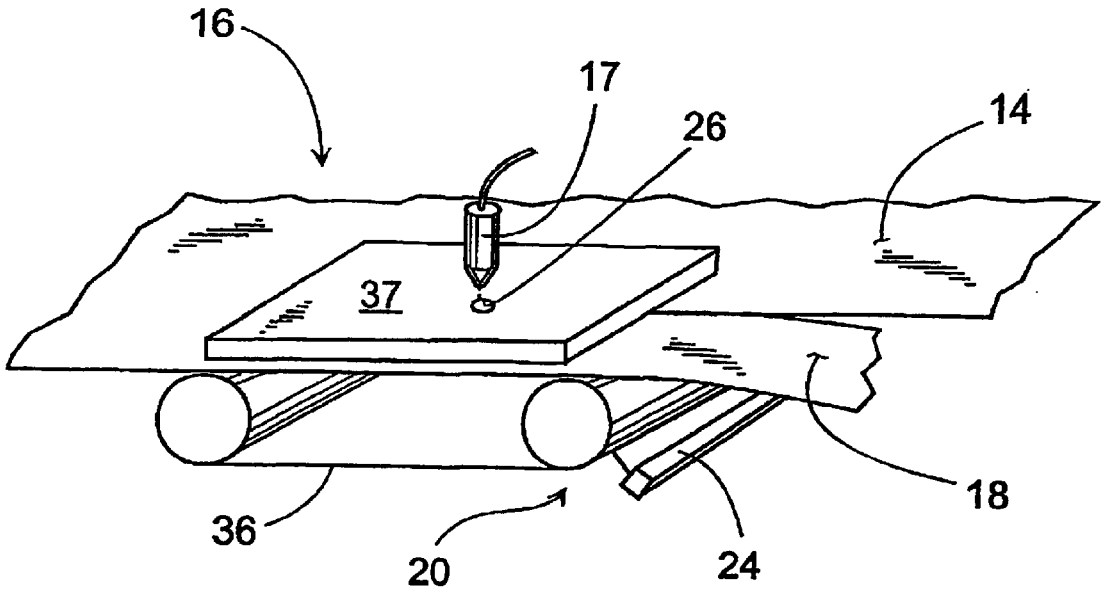
FIGS. 7*a* and 7*b* show a side view of a ninth and tenth embodiment of the cutting head of the equipment according to the invention.
Figure 7B:
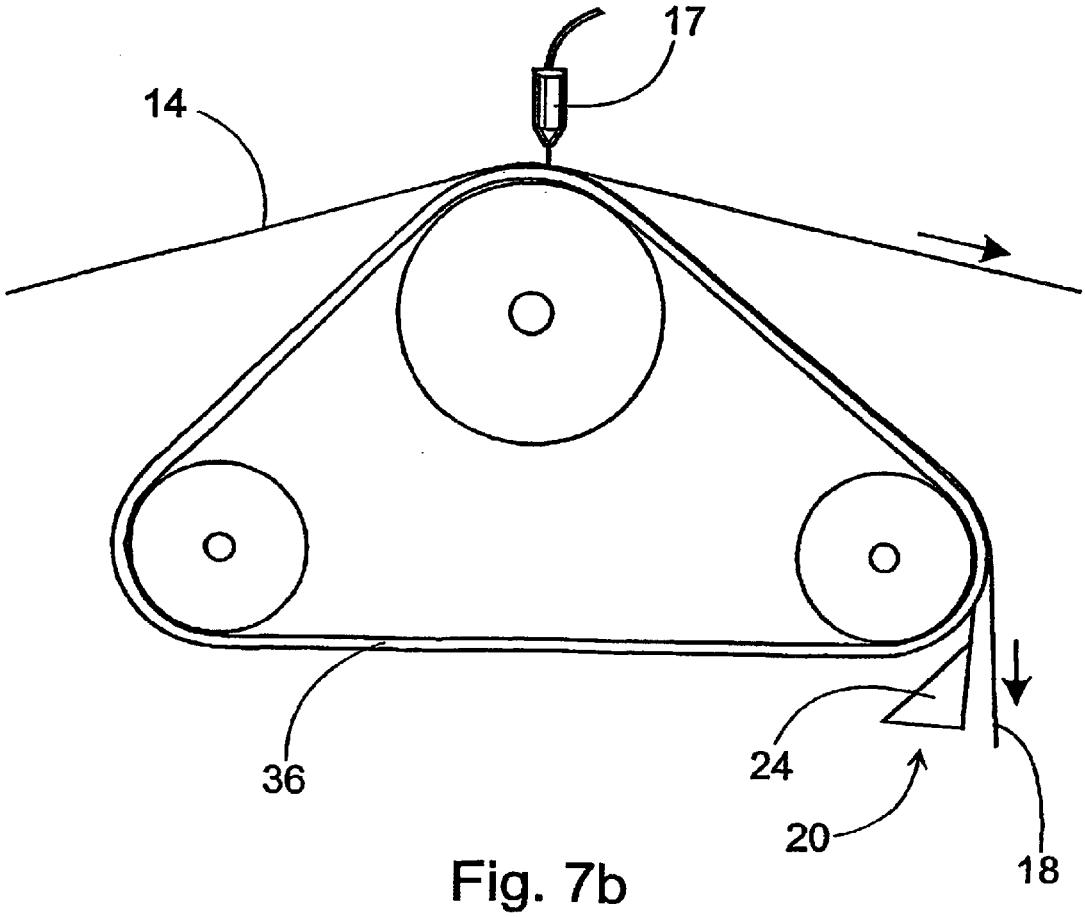

In addition to support surfaces arranged to rotate in relation to a horizontal or vertical axis, it is possible to use a fabric loop 36 as the support surface, as shown in FIGS. 7*a* and 7*b*. In FIG. 7*a*, the paper web 14 is arranged to travel between the fabric loop 36 and an auxiliary surface 37. Cutting takes place through the hole 26 of the surface 37, against the fabric loop 36. The water collection equipment is not shown. The fabric loop 36 can be easily cleaned beneath the paper web 14, with, for example, a scraper 24.

In FIG. 7*b*, there is also an endless fabric loop 36, the main purpose of which is the controlled movement of the edge strip 18. In other words, after cutting, the edge strip 18 adheres to the fabric loop 36, by means of which it is transported away from the equipment. To ensure the transfer, a vacuum can be used inside the fabric loop 36. The solution described is particularly suitable for use with the support surface shown in FIG. 5*a*.

Figure 8A:
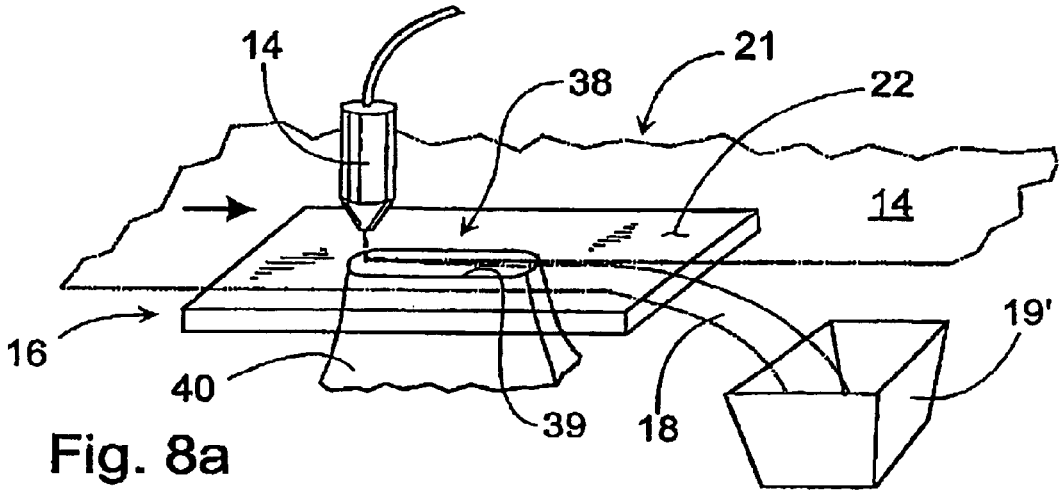
FIGS. 8*a*, 8*b*, and 8*c* show a side and top view in partial cross-section of an eleventh and twelfth embodiment of the cutting head of the equipment according to the invention.

The various embodiment described above are for cleaning the support surface. According to the invention, the support surface can also be kept clean by preventing it from becoming dirty. Generally, this is achieved by forming a cut 38 in the support surface 16 after the cutting point formed by the water jet, in the direction of travel of the paper web 14. At its simplest, this can be implemented in the manner shown in FIG. 8*a*. In this case, the table 22 is nearly conventional, but the hole 26 in it is extended to form a cut 38. In practice, the cut 38 is a narrow gap 39, which extends forwards from the cutting point in the direction of travel of the paper web 14. Thus, a detrimental lump is not able to form.

Figure 8B:
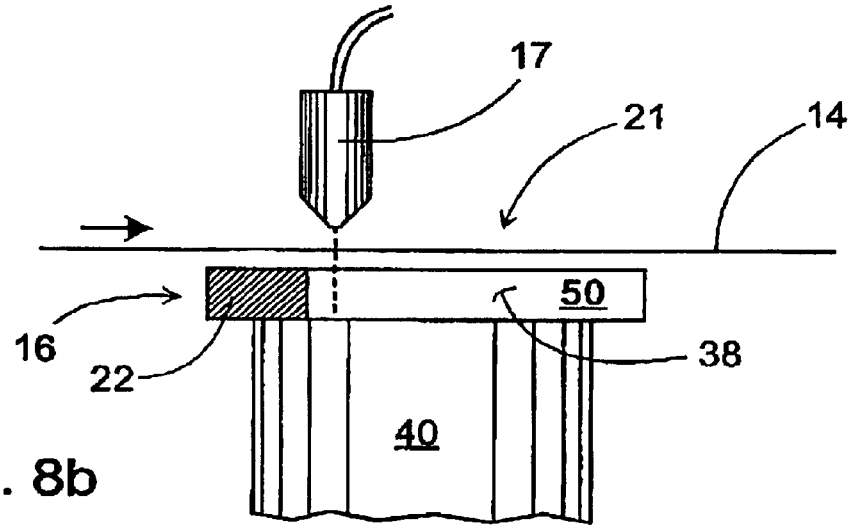
Figure 8C:
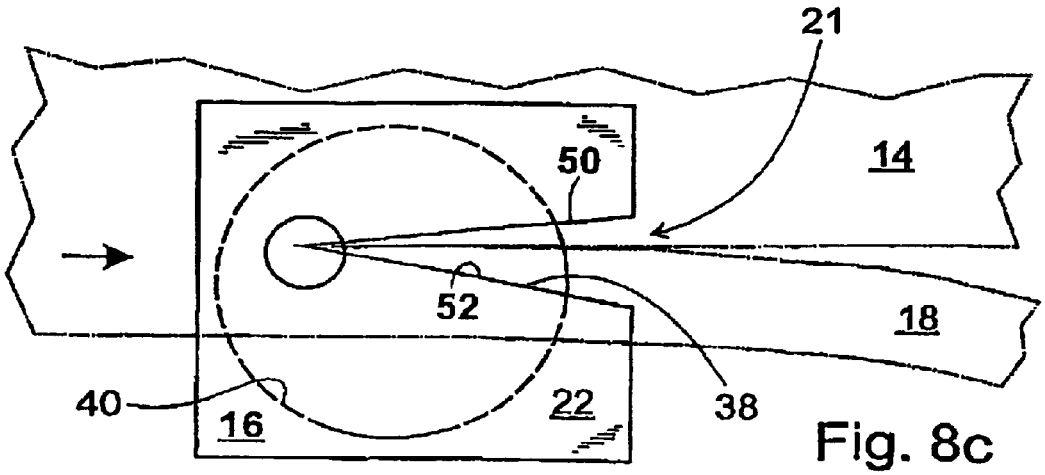
Figure 9A:
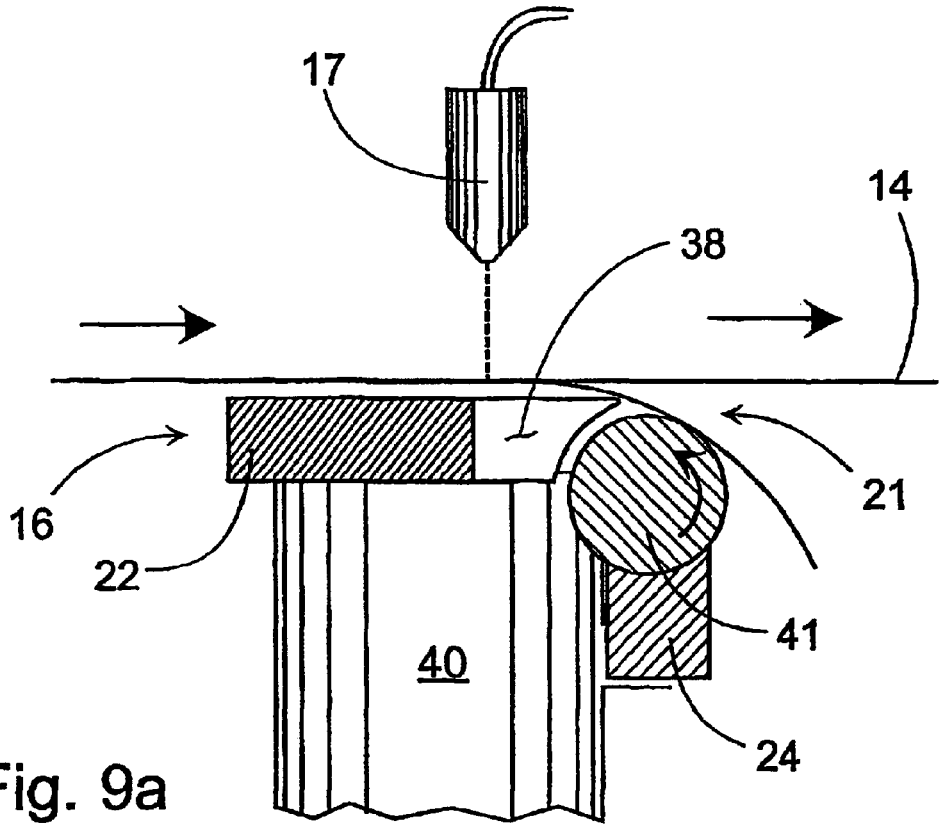
FIGS. 9*a* and 9*b* show a side and top view in partial cross-section of a thirteenth embodiment of the cutting head of the equipment according to the invention.
Figure 9B:
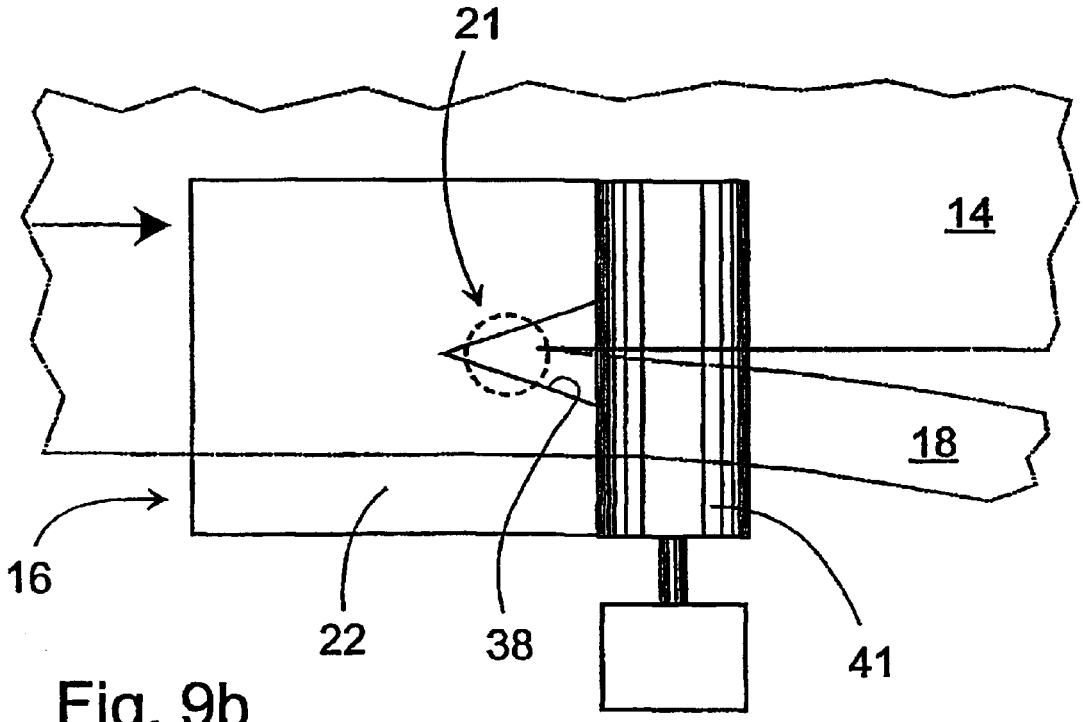

The cut 38 can also be enlarged, without this significantly disturbing the travel of the paper web. FIGS. 8*b* and 8*c* show a table 22, in which there is a triangular cut 38. In addition, there is an outlet connection 40, in which there is a vacuum, beneath the table 22. Thus, the replacement air travels through the cut 38 to the outlet connection 40, which promotes the support surface 16 remaining clean and the removal of the cutting waste. The cut 38 is positioned between a first portion 50 of the support surface 16 defined by the table 22 and a second portion 52 of the support surface, the first portion being spaced from the second portion across the cut in a cross-machine direction perpendicular to the direction of travel of the paper web. The cut 38 widens in the direction of travel of the paper web, such that the distance in the cross-machine direction between the support surface first portion 50 and the support surface second portion 52 increases with a greater distance in the direction of travel of the paper web 14 from a cutting position of the cutting head in the operating position, the cut defining a triangular opening in the suport surface. In FIGS. 9*a* and 9*b*, there is also a triangular cut 38 and a vacuum connection 40. In addition, a cleaning roller 41, which rotates against the direction of travel of the paper web 14, is located after the table 22. Loose pieces of cutting waste adhere to the cleaning roller 41, which is then cleaned, for example, with a scraper 24. The support surfaces described above can also be cleaned during a maintenance shutdown or roll changing, by means of a separate cleaning device belonging to the equipment, as stated previously.

The equipment according to the invention operates reliably while the support surface remains clean. In addition, the arrangement of the equipment can be made suitable for different operating situations. The cleaning effect can be easily increased by combining features of different embodiments in a single set of equipment. The cleaning means or constructions of the equipment according to the invention are arranged on the opposite side of the paper web to the nozzle, in connection with the support surface. In that case, the cleaning is ensured by means of mechanical cleaning means, without the movement of the paper web being disturbed by it. When the support surface remains clean, the probability of a web break, for example, is significantly reduced.

What is claimed is:

1. Apparatus for cutting a paper web with a water jet, the apparatus comprising:

a cutting head extending in an operating position to an area of an edge part of the paper web, the cutting head having a support surface arranged at least beneath the edge part, and the cutting head having at least one nozzle above the area of the edge part for forming a cutting jet with the aid of high-pressure water, the nozzle being set in such a way that the edge part travels between the support surface and the nozzle, in order to cut an edge strip from the paper web;

support and positioning means for supporting the cutting head and for adjusting the nozzle and the support surface in the cross-direction of the paper web;

a connection opening in the direction of the cutting jet and set beneath the support surface for collecting and removing cutting water from the apparatus; and a cleaning construction arranged to the opposite side of the paper web to the nozzle, in connection with the support surface, the cleaning construction comprising portions of the support surface defining a cut extending in the direction of travel of the paper web from a cutting point formed by the water jet, the cut serving to prevent the dirtying of the support surface, wherein the cut is positioned between a first portion of the support surface and a second portion of the support surface, the first portion being spaced from the second portion across the cut in a cross-machine direction perpendicular to the direction of travel of the paper web.

2. The apparatus of claim 1, wherein the cut widens in the direction of travel of the paper web, such that the distance in the cross-machine direction between the support surface first portion and the support surface second portion increases with a greater distance in the direction of travel of the paper web from a cutting position of the cutting head in the operating position, the cut defining a triangular opening in the support surface.

3. The apparatus of claim 1, wherein the cut is a narrow gap.

4. The apparatus of claim 1, wherein cleaning means are arranged in the support surface after the cut, to collect dirt detaching from the cut.

* * * * *